United States Patent [19]

Okamoto et al.

[11] 4,136,221

[45] Jan. 23, 1979

[54] SUEDE-LIKE RAISED WOVEN FABRIC AND PROCESS FOR THE PREPARATION THEREOF

[75] Inventors: Miyoshi Okamoto; Syusuke Yoshida, both of Otsu, Japan

[73] Assignee: Toray Industries, Inc., Tokyo, Japan

[21] Appl. No.: 857,354

[22] Filed: Dec. 2, 1977

Related U.S. Application Data

[63] Continuation of Ser. No. 745,161, Nov. 26, 1976, abandoned.

[30] Foreign Application Priority Data

Jul. 17, 1976 [JP] Japan ..... 51-70379

[51] Int. Cl.[2] ..... B29D 27/00; D04H 1/64

[52] U.S. Cl. ..... 428/91; 28/159; 28/162; 28/168; 264/174; 428/258; 428/369; 428/373

[58] Field of Search ..... 28/159, 162, 168; 428/91, 96, 151, 258, 369, 370, 373, 374; 264/171, 174; 139/35, 37, 392

[56] References Cited

U.S. PATENT DOCUMENTS

| | | | |
|---|---|---|---|
| 3,705,226 | 12/1972 | Okamoto et al. | 428/904 |
| 3,865,678 | 2/1975 | Okamoto et al. | 428/91 |

*Primary Examiner*—William J. Van Balen

*Attorney, Agent, or Firm*—Cushman, Darby & Cushman

[57] ABSTRACT

Disclosed is a suede-like raised woven fabric of a combination weave having raised extra fine fibers on the surface thereof, which fabric comprises a continuous multifilament yarn used as warp, a yarn of a bundle comprising continuous extra fine filaments used as a first weft and a continuous multifilament yarn used as a second weft. The preparation of the raised fabric comprises weaving a fabric using appropriate material yarns, subjecting the fabric to heat treatment and subjecting the fabric to raising. The yarn constituting the first weft may be produced from a bundle of multi-core composite filaments by removing a component surrounding the cores. The fabric has an excellent suede-like touch, appearance and feel.

27 Claims, 8 Drawing Figures

SUEDE-LIKE RAISED WOVEN FABRIC AND PROCESS FOR THE PREPARATION THEREOF

This is a continuation, of application Ser. No. 745,161 filed Nov. 26, 1976, now abandoned.

BACKGROUND OF THE INVENTION

The invention relates to a raised woven fabric of a combination weave having a surface covered with raised extra fine fibers and having a suede-like touch, appearance and feel, and to a process for the preparation thereof.

As raised woven fabrics having extra fine fibers used therein and having a suede-like appearance and feel, there has heretofore been known: raised woven fabrics comprising a spun yarn of an extra fine fiber bundle used as weft and a spun yarn of an ordinary fineness used as warp, and; raised woven fabrics comprising a spun yarn of an extra fine fiber bundle used as weft and a textured multifilament yarn of an ordinary fineness used as warp (see, for example, U.S. Pat. No. 3,865,678).

These conventional raised woven fabrics have some excellent features as a suede-like fabric, which are not limited to the features due to the spun yarn consisting of short-cut staples made from an extra fine fiber bundle employed in the fabric. However, they have the following drawbacks as a fabric and in the preparation thereof.

(1) The commercial value of the product becomes low, because of the appearance of fuzz on the reverse side thereof.

(2) The use of the product is limited, because the used short-cut staples tend to produce naps of cut fibers but not looped fibers.

(3) The raised fibers tend to fall out and to produce pills, because the length of the fibers is short. Thus, the fabric requires a large amount of an anti-pilling agent.

(4) The surface appearance is not flat due to twist irregularity, naps, knots and yarn unevenness which are natural to spun yarns.

(5) The fineness of a spun yarn is limited and, thus, sheer fabrics can not be made.

(6) The bending direction of the raised fibers easily yields and, thus, raised fibers having opposite bending direction tend to be produced, particularly when an anti-pilling agent is used.

(7) In the case where a yarn of a fiber bundle from an islands-in-sea type composite fiber is used, fiber bundle cleavage, card wasting, tube clogging in drawing, helices, yarn unevenness and yarn breakage occur and necessitate complicated manual operations and, further, necessitate the mending of intermediate and final products.

(8) In the case where a yarn of a bundle of an islands-in-sea type composite fibers is used, the extra fine fibers easily fall out upon the removal of the sea component.

(9) Extra fine fibers easily fall out upon raising.

(10) The naps of raised fibers are not uniform in length and, thus, shearing and napping are required.

(11) The feel of the fabric may not be the same in longitudinal and latitudinal directions.

(12) The appearence of the fabric becomes aged with repeated washing.

The above drawbacks of the conventional raised woven fabric have not been eliminated despite many concerted efforts to do so.

SUMMARY OF THE INVENTION

The present invention is the result of thorough studies to clear up the causes of the above-mentioned drawbacks and to introduce into such a fabric a specific construction derived from the investigation of the causes.

It is, accordingly, an object of the invention to eliminate the drawbacks of the conventional raised woven fabrics.

Another object of the invention is to provide a suede-like raised woven fabric being excellent in feed, appearance and crease resistance, and having longitudinally and latitudinally balanced excellent draping quality and permanent pleating quality.

Sill another object of the invention is to provide a suede-like raised woven fabric having a desirable uniform width and a reverse side surface slippery enough to require no lining cloth when garments are manufactured therefrom.

Further objects of the invention will become clear from the description presented hereinbelow.

The above-mentioned objects of the invention can be attained by the following construction according to the invention.

The invention provides a suede-like raised woven fabric of a combination weave having raised fibers covering the surface thereof. The fabric comprises:

a 30 to 300 denier yarn consisting mainly of continuous filaments, the mono-filament denier of which is 1.0 to 8.0 denier, used as warp;

a 50 to 1,000 denier yarn of a bundle comprising continuous extra fine filaments, the mono-filament denier of which is 0.0001 to 0.4 denier, used as a first weft, and;

a 30 to 300 denier yarn consisting mainly of continuous filaments, the mono-filament denier of which is 1.0 to 8.0 denier, used as a second weft;

each thread of said first weft floating toward the adjoining 3 to 7 threads of said warp and said raised fibers consisting of said extra fine filaments which constitute said first weft of said fabric.

The invention also provides a process for the preparation of a suede-like raised woven fabric, which comprises the steps consisting of:

(a) weaving a fabric of a combination weave, wherein each thread of a first weft floats toward the adjoining 3 to 7 threads of warp, using as the warp a 30 to 300 denier yarn consisting mainly of continuous filaments, the mono-filament denier of which is 1.0 to 8.0 denier, using as the first weft a yarn of multi-core composite filaments producing a 50 to 1,000 denier yarn of a bundle comprising continuous extra fine filaments, the mono-filament denier of which is 0.0001 to 0.4 denier, and using as a second weft, a 30 to 300 denier yarn consisting mainly of continuous filaments, the mono-filament denier of which is 1.0 to 8.0 denier;

(b) removing a component surrounding the cores of said multi-core composite filaments of the yarn constituting said first weft of the woven fabric;

(c) subjecting the woven fabric to heat treatment, and;

(d) subjecting the woven fabric to raising.

The invention further provides a process for the preparation of a suede-like raised woven fabric, which comprises the steps consisting of:

(a) weaving a fabric of a combination weave, wherein each thread of a first weft floats toward the adjoining 3 to 7 threads of warp, using as the warp a 30 to 300 denier yarn consisting mainly of continuous filaments, the mono-filament denier of which is 1.0 to 8.0 denier, using as the first weft a 50 to 1.000 denier yarn of a bundle comprising continuous extra fine filaments, the mono-filament denier of which is 0.0001 to 0.4 denier, and as a second weft, a 30 to 300 denier yarn consisting mainly of continuous filaments, the mono-filament denier of which is 1.0 to 8.0 denier;

(b) subjecting the woven fabric to heat treatment, and;

(c) subjecting the woven fabric to raising.

The features and effects of the invention obtained from the above-mentioned structures and processes are illustrated as follows.

FEATURES AND EFFECTS OF THE INVENTION

1. The feel of the fabric is balanced in the longitudinal and latitudinal directions.
2. Raised fibers are uniform and have no opposite bending direction.
3. Pilling resistance is excellent, even if a small amount of an anti-pilling agent has been used.
4. The fabric has longitudinally and latitudinally balanced excellent permanent pleating quality.
5. Crease resistance is excellent.
6. The appearance and feel are unlikely to be changed by repeated washing.
7. A troublesome spinning step is not necessary.
8. The fabric has no thread slippage.
9. Raised fibers are unlikely to be entangled.
10. Fuzz is unlikely to be seen on the reverse side and the reverse side surface has a smooth feel.
11. Loss of the core-surrounding component to be removed and loss of the solvent for the removal of the core-surrounding component are small.
12. Fabrics of any desirable thicknesses from sheer to heavy can be obtained.
13. The surface appearance is flat.
14. The fabric is suitable for practical use, even if no anti-pilling agent applied thereto.
15. Fibers are unlikely to fall out and shearing and napping are not necessary.
16. Color fastness is food, because an antic pilling agent is sparingly or not at all required.
17. Weaving is easy due to the use of filament yarns.

Because of the above features and effects, the raised woven fabric of the invention successfully overcomes drawbacks which have heretofore been overcome, as shown in the comparative tables.

Comparative Table 1

| Conventional raised or flocked fabric | Product of the invention. |
|---|---|
| Pilling resistance is poor | Pilling resistance is excellent |
| Surface feel is rough | Surface feel is smooth |
| Raised fibers are coarse | Raised fibers are quite dense |
| Finger marks do not appear | Finger marks easily appear |
| There are fallen fibers | There are few fallen fibers |
| Draping quality is poor | Draping quality is excellent |
| Textile weave is conspicuous | Textile weave is unlikely to be seen |

Comparative Table 1-continued

| Conventional raised or flocked fabric | Product of the invention. |
|---|---|
| Raised fibers are not like those of suede | Raised fibers are like those of suede |
| Feel is hard and harsh | Feel is soft |
| Raised fibers are not lustrous | Raised fibers are lustrous |
| Raised fibers are uniform, having no variaton | Raised fibers have variation |

Comparative Table 2

| Conventional extra fine materials | Product of the invention |
|---|---|
| Pilling resistance must be improved by an anti-pilling agent | Pilling resistance is good where no anti-pilling agent is used |
| Balance between warp and weft is not uniform | Balance between warp and weft is uniform |
| Permanent pleating quality is poor | Permanent pleating quality is excellent |
| Reverse side surface is rought, having fuzz | Reverse side surface is slippery, having little fuzz |
| Sheer faric can not be obtained | Sheer fabric can be obtained |
| Naps are disordered by rubbing against the grain | Naps are unlikely to be disordered by rubbing against the grain |
| Crease resistance is poor | Crease resistance is excellent |
| Draping quality becomes poor through washing | Appearence and feel are not changed through washing |

DESCRIPTION OF THE INVENTION

Figure 1:
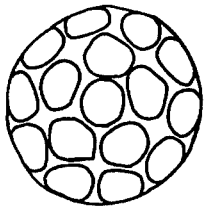
FIGS. 1 and 2 are schematic illustrations of a cross-section of an islands-in-sea type composite filament.

The invention is described hereinbelow in detail with reference to the preferred embodiments.

As the fiber-forming polymers consistuting the fabric of the invention, various known fiber-forming polymers, such as polyethylene terephthalate and copolymers thereof, nylon 6, nylon 66 and nylons containing cylohexane ring or benzene ring, may be employed alone or in combination. However, as the polymer for the extra fine filaments, polyesters capable of being dyed more deeply than the filaments of ordinary fineness, such as those containing much amino groups (acid dyeable) or much sodium sulfonate groups (cationic dyeable), are preferably employed. This is because the extra fine filaments having dyeability similar to that of the filaments of ordinary fineness tend to appear, when dyed, more light than the filaments of ordinary fineness. Thus, the colors of the extra fine filaments and of the filaments of ordinary fineness can be balanced. However, if desired, a combination of different polymers dyeable with different classes of dyes can be employed so as to obtain a multi-colored fabric or a fabric of different colored front and reverse side surfaces.

As the warp, any continuous multi-filament yarn may be employed according to the use of the resulting fabric. If a voluminous puffy fabric is to be obtained, a textured bulky yarn or a yarn having crimping capacity rendered by texturning or conjugate spinning may be employed. Where a slippery sheer fabric is to be obtained, a yarn which is not textured or has been once subjected to texturing to generate a crimp and thereafter the crimp has been substantially eliminated, for example, by stretching and heat setting, may be employed so that the resulting fabric does not contain crimps in its textile organization.

The mono-filament denier of the filaments of the warp yarn must be in a range between 1.0 d and 8.0 d. When the denier is less than 1.0 d, because the warp is too fine, the resulting fabric becomes poor in crease resistance and in repulsiveness. Contrary to this, when the denier is more than 8.0 d, the fabric becomes stiff and has a harsh and hard feel and a harsh feeling reverse side surface.

The yarn constituting the warp has a total denier in a range between 30 d and 300 d. When the total denier is less than 30 d, processing such as weaving becomes difficult because of the occurrence of yarn breakage, for example. When the total denier is more than 300 d, the resulting fabric becomes too thick and has an undesirable feel, and further, the textile weave becomes coarse. Particularly, where a high class sheer fabric is to be obtained, the total denier of the warp yarn is preferably in a range between 40 d and 100 d.

Figure 2:
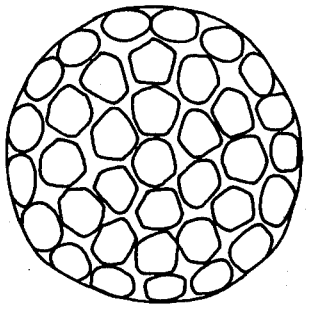

The fabric of the invention contains, as the first weft, a yarn of a bundle comprising extra fine filaments. The total denier of this yarn is in a range between 50 d and 1,000 d and the mono-filament denier of the extra fine filament is in a range between 0.0001 d and 0.4 d. The bundle of such extra fine filaments may be obtained, for example, by removing a component surrounding the cores of a multi-core filament bundle, for example, by removing the sea component of an islands-in-sea type composite filament bundle, by removing the dispersing component of a special polymer blend filament bundle or by a super-drawing method or a composite fiber separation method. Islands-in-sea type composite filaments having cross-sections as shown in FIGS. 1 and 2 are most preferably employed in the invention.

Figure 3:
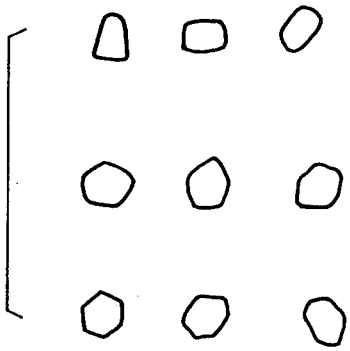
FIGS. 3 and 4 are schematic illustrations of cross-sections of islands contained in an islands-in-sea type composite filament.
Figure 4:
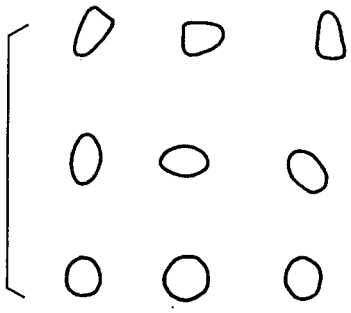
Figure 5:
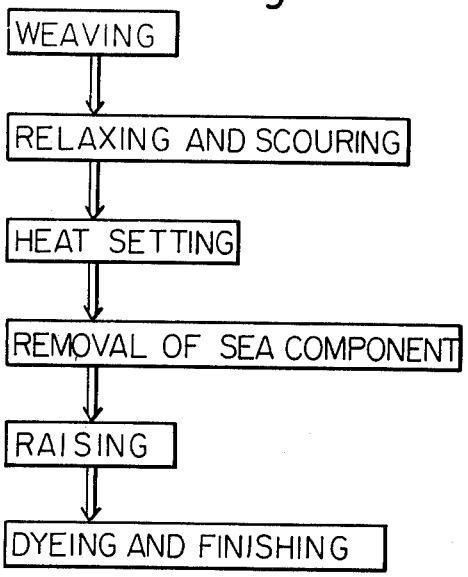
FIGS. 5 through 8 are process flow sheets of preferred embodiments of the invention.
Figure 6:
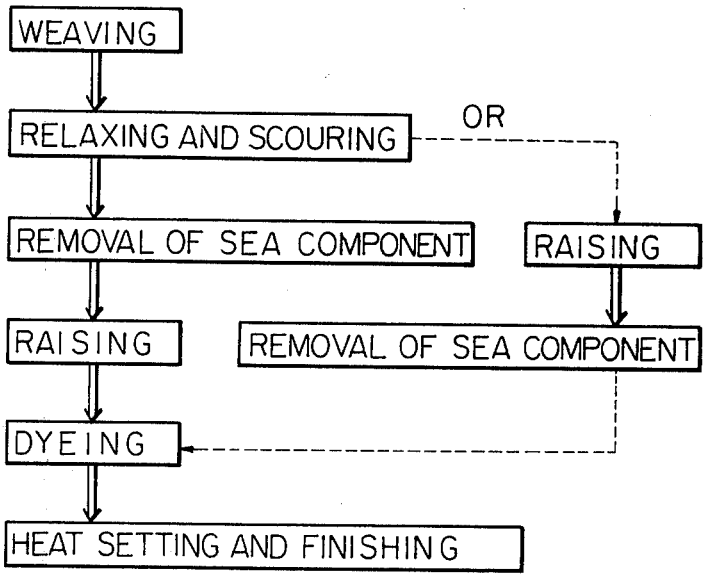
Figure 7:
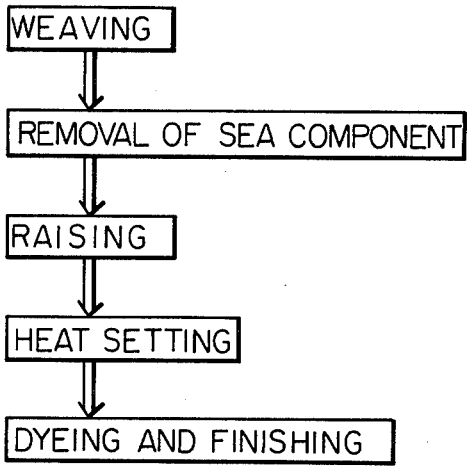
Figure 8:
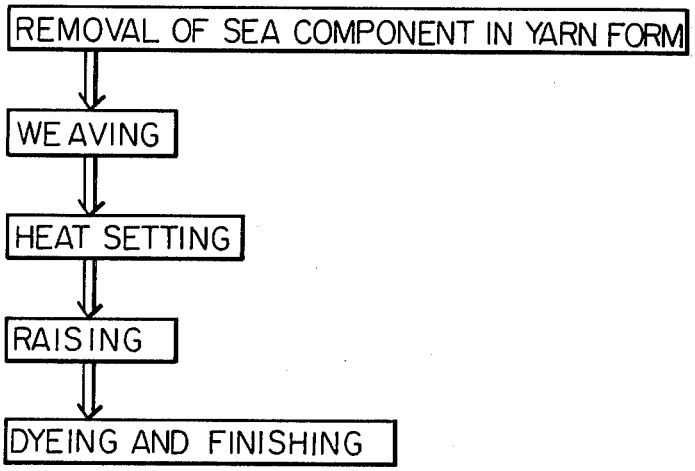

Of the islands-in-sea type composite filaments, those which contains no less than 65%, especially 70 to 90%, of island component are preferred. This is because a raised woven fabric having elegantly loustrous raised fibers, wherein thread slippage is unlikely to occur, can be obtained, and loss of the sea component and loss of the solvent for the removal of the sea component are small. In order to increase the percentage of the island component, it is preferred to bring the viscosity of the island component as close as possible to the viscosity of the sea component, when spinning. The cross-sections of the islands are preferably in forms of rounded cornered squares, pentagons and hexagons as shown in FIG. 3. The islands of cross-sections having no angle or having two or three angles as shown in FIG. 4 are not preferred.

The extra fine filaments constitute the first weft and the raised fibers in the fabric. Thus, the raised fibers consist of the extra fine filaments and produce a suede-like desirable feel and appearance on the fabric. Although the first weft may contain filaments of a denier outside of the above-mentioned range, insofar as such suede-like quality of the fabric is not very adversely affected, it is preferred that the first weft contain as few such filaments as possible.

The raising of the extra fine filaments may be carried out by means of a raising machine and the like. The raising of the filaments of the yarn of multi-core composite filaments contained in the fabric and producing a yarn of a bundle comprising extra fine filaments through removing the core-surrounding component may be carried out either before or after the removal of the core-surrounding component. However, it is preferred that the raising be carried out after the removal of the core-surrounding component.

The total denier of the yarn for the first weft is preferably in a range between 70 d and 450 d. This is because the use of such a yarn can produce a compact textile weave and nicely raised fibers on the resulting fabric.

As the second weft, a multifilament yarn of a total denier in a range between 30 d and 300 d, consisting mainly of filaments of a mono-filament denier in a range between 1.0 d and 8.0 d, is employed. When the mono-filament denier is less than 1.0 d, the resulting fabric becomes poor in puffiness. When the mono-filament denier is more than 8.0 d, the fabric has a harsh feeling reverse side surface. Particularly, the mono-filament denier is preferably in a range between 1.5 d and 4.0 d.

For the extra fine filaments constituting the first weft, it is preferred to employ a polymer of the same generic as those for the filaments constituting the warp and the second weft.

The textured bulky yarns employable for the warp and the second weft may be selected from the various well-known textured yarns.

The respective yarns used as warp, a first weft and a second weft, are woven into a weft backed weave so that the first weft mainly appears on the front side surface of the woven fabric, while the second weft mainly appears on the reverse side surface. Preferably, the face mainly containing the first weft has a weave from 4-harness twill to 8-harness satin. Thus, each thread of the first weft preferably floats toward the adjoining 3 to 7 threads of the warp. The number of the second weft floats may be the same as or different from that of the first weft floats. For example, where the number of the first weft floats is 4, the number of the second weft floats may be 4. Where the number of the first weft floats is 7, the number of the second weft may be 1. However, the number of the first weft floats should be from 3 to 7. The woven fabric preferably has selvages.

In the practice of the invention, various combinations of the steps may be employed. Examples of the preferred embodiments are shown in the process flow sheets of FIGS. 5 through 8.

The woven fabric having such a combination weave is subjected to heat treatment before or after the raising. From the point of view of dimensional stability, it is preferred that the heat treatment be carried out before the raising. The heat treatment includes at least one of the bulking up and heat setting heat treatments. With respect to polyester fibers, the heat setting may preferably be carried out at a temperature between 140° C. and 230° C., while the bulking up may be carried out by immersing the fabric in boiling water.

Where the woven fabric contains as the first weft a yarn of multi-core composite filaments, the fabric is subjected to a treatment for the removal of the core-surrounding component (sea component). The removal of the core-surrounding component may be effected with a solvent and the like. For example, if the sea component is a polymer of styrene, a solvent such as trichloroethylene, perchloroethylene, toluene or xylene may be used. The removal of the sea component may be carried out before or after the raising, but the removal before the raising is preferred.

The woven fabric is, in addition, subjected to raising. The raising includes wire card clothing raising, teasel raising, emerizing, brushing and the like. Of these, the card clothing raising is particularly preferred.

The fabric thus obtained may be further treated with a finishing agent such as an anti-pilling agent, for example, an emulsion or solution of a polyurethane resin, or a snagging, resin finishing, anti-fraying or anti-slippage agent. These finishing agents may be applied in an appropriate amount and by a convenient method.

Where the fabric is treated with an anti-pilling agent of a polyurethane resin emulsion, it is particularly preferred that the fabric be firstly treated with a sizing agent, then treated with the anti-pilling agent and thereafter the sizing agent is removed. This is because the resin can be impregnated deeply in the organization of the fabric without imparting an adverse effect to the raised fibers. Also, by such a measure, the reverse side surface can have a smooth feel despite having been treated with the resin.

If desired, the fabric may be subjected to further finishing treatments such as dyeing, shearing, brushing, anti-static finishing, finishing oiling, flame-retarding finishing, polishing, water-repelling finishing, soil-releasing finishing, sliming finishing and the like. Shearing has been proved to be advantageously effected where the reverse side surface is fuzzy. Polishing and sliming finishing may preferably be effected during or after dyeing using a silicone finishing agent. The feel of the fabric may be changed by heat pressing or ironing. Dyeing may be carried out before or after the raising, preferably by a circular type pressing dyeing machine wherein the dye bath is circulated with the fabric to be dyed.

As hereinbefore mentioned, it is preferred, in general, that the extra fine filaments have a depth of color the same as that of the other filaments of ordinary fineness contained in the fabric. It has been found that when the fabric is dyed with a disperse dye, the extra fine filaments are firstly deep dyed and, then, the other filaments of ordinary fineness become deep dyed with the lapse of time while the depth of the color of the extra fine filaments is decreased. Thus, in order to obtain the same depth of color on both the extra fine filaments and the filaments of ordinary fineness, it has been proved that dyeing should be stopped after the lapse of a certain dyeing time. For example, where the fabric is dyed with a disperse dye in a circular type pressing dyeing machine, the suitable dyeing time is 45±5 minutes at 125° C. and 60±5 minutes at 120° C.

The raised fibers can be bent in any desirable direction. It is preferred that the raised fibers be violently raked with the liquid during dyeing. This is because the raised fibers then become likely to be seen as being very dense. It is also preferred that the raised fibers be combed or brushed after dyeing but before drying. The raised fibers may be intentionally disordered so as to obtain a fabric having a fancy appearence.

Upon dyeing or hot water treatment, for example, at a temperature of 90° to 130° C. in a circular type pressing dyeing machine wherein the dye bath is circulated with the fabric to be dyed, the raised fabric may preferably be treated in tubular forms of two types, one of which is in a tubular form such that one selvage is piled up the other selvage and they are sewn together so as to set the raised side of the fabric outside and the other in a tubular form such that the respective pairs of the piled up selvages of two pieces of the fabric are sewn so as to set the raised sides of the two pieces of the fabric outside. This is because the raised fibers of the resulting fabric have uniform bending direction, finger marks are very easily produced on the raised side of the resulting fabric and, further, the reverse side of the resulting fabric has very little fuzz in a pill form.

Because of the aforementioned desirable features of the raised woven fabric of the invention, the fabric has many uses, such as for high class articles of clothing, for example, coats, dresses, shirts and trousers, and; in addition, for bags, shoes, carpets, filters, swaddling clothes, menstruation articles, cushions, substitutes of felt and leather, sporting articles, chair covers, medical supplies, blankets, wiping cloths, fishery articles and agriculture and forestry articles.

The invention will now be further illustrated by the following illustrative, but not limitative, examples.

EXAMPLE 1

A 5-harness satin weft backed weave was made so that the woven density became 134 warps/in, 82 first wefts/in and 82 second wefts/in. As the warp, a 50 denier/24 filament yarn of polyethylene terephthalate (Trade Mark "Tetoron" by Toray Industires Inc.) was used; as the first weft, a 232 denier/84 filament yarn of islands-in-sea type composite filaments, wherein the island component consisted mainly of polyethylene terephthalate, the sea component consisted mainly of polystyrene, the percentage of the island component was 70%, the percentage of the sea component was 30% and the number of islands was 16, was used, and; as the second weft, a 50 denier/24 filament false twisted wooly polyethylene terephthalate yarn (Trade Mark "Woollie Tetoron" by Toray Industries Inc.) was used.

This woven fabric was immersed in boiling water, desized, relaxed and scoured, and then, heat set and dried at 180° C. The set and dried fabric contracted by 11.1% longitudinally and by 18.9% latitudinally and became hard like cardboard.

The fabric was thoroughly washed 3 times with trichloroethylene to remove the sea component of the first weft and then dried. Then, after applying a raising oil agent, the fabric was passed through a card clothing raising machine 14 times. Thus, a raised fabric was obtained, the surface of which was covered by raised fibers consisting of extra fine fibers of the first weft.

The fabric was then dyed a light brown shade with a disperse dye in a pressing dyeing machine and treated with a finishing oiling agent.

The obtained fabric was a suede-like weft backed raised woven fabric having balanced warp and weft, was excellent in draping quality and in permanent pleating quality and had a thickness of 0.45 mm. The surface naps were dense, and the surface of the fabric had a soft feel and was lustrous, whereon finger marks were easily produced.

EXAMPLE 2

The procedure in backed Example 1 was repeated, except that, in order to render pilling resistance and snag resistance to the product, the raised fabric passed through the raising machine was impregnated with an aqueous liquor containing 2% by weight of an anionic bisulfite adduct of polyisocyanate polyurethane, expressed, dried at 150° C. and then brushed. Then, the fabric was dyed and finished in the same manner as in Example 1.

The obtained weft backed raised woven fabric was excellent in pilling resistance and in snag resistance, and had balanced warp and weft and surface naps like those of a natural suede.

EXAMPLE 3

A 700 denier/312 filament yarn of islands-in-sea type composite filaments, wherein the island component consisted mainly of polyethylene terephthalate, the sea component consisted mainly of polystyrene, the percentage of the island component was 55%, the percentage of the sea component was 45% and the number of islands was 16, was washed 4 times with trichloroethylene to remove the sea component and obtain a 385 denier/4,992 filament yarn, the mono-filament denier of which was about 0.077d. Then, a 5-harness satin weft backed weave was made, so that the woven density became 114 warps/in, 55 first wefts/in and 55 second wefts/in. Used as the warp was a 100 denier/48 filament yarn of polyethylene terephthalate (Trade Mark "Tetoron"), as the first weft, the 385 denier/4,992 filament yarn and as the second weft, a 100 denier/48 filament false twisted polyethylene terephthalate yarn (Trade Mark "Woollie Tetoron").

This woven fabric was immersed in boiling water, desized, relaxed and scoured, and then, heat set and dried at 180° C. During this treatment, the fabric contracted by 9.5% longitudinally and by 12.5% latitudinally.

The fabric was then dyed a beige shade with a disperse dye in a pressing dyeing machine, treated with a softening agent and an antistatic agent and dried in a cylinder dryer. Then, the fabric was passed through a card clothing raising machine 13 times to obtain a raised fabric, the surface of which was covered by raised fibers consisting of extra fine fibers of the first weft. Subsequently, the raised fabric was passed through a shearing machine 2 times to make the lengths of the raised fibers uniform.

Thus, a high class suede-like weft backed raised woven fabric having balanced warp and weft and being pliant and excellent in permanent pleating quality was obtained. The surface of the fabric was lustrous and the density of the raised fibers was large so that the textile weave of the surface could only slightly been seen.

EXAMPLE 4

A raised fabric processed in the same manner as in Example 3 was impregnated with a 1.5% by weight liquor of an aqueous polyurethane emulsion, expressed between a pair of nip rolls, heat set and dried at 160° C., and then, the surface of the fabric was subjected to finishing brushing.

A high class suede-like weft backed raised woven fabric being excellent in pilling resistance and in snag resistance was obtained. The fabric had a soft and smooth feeling surface whereon finger marks were easily produced.

EXAMPLE 5

Using a 75 denier/18 filament yarn of polyethylene terephthalate (Trade Mark "Tetoron") as warp and as second weft, and a 337 denier/156 filament yarn of islands-in-sea type composite filaments, wherein the island component consisted mainly of polyethylene terephthalate, the sea component consisted mainly of polystyrene, the percentage of the island component was 80%, the percentage of the sea component was 20% and the number of islands was 36, as first weft, a 5-harness satin weft backed weave was made so that the woven density became 119 warps/in, 53 first wefts/in and 53 second wefts/in.

This woven fabric was immersed in boiling water, desized, relaxed and scoured and then heat set and dried at 180° C. During this treatment, the fabric contracted by 9.0% longitudinally and by 16.0% latitudinally. Then, the fabric was further processed as described in Example 1.

A suede-like weft backed raised woven fabric having balanced warp and weft, and being excellent in draping quality and in permanent pleating quality was obtained. The fabric had a lustrous surface which was soft and smooth to the touch, and the surface naps had uniform directional property. The reverse side of the fabric was slippery so that no lining cloth would be necessary if a garment were manufactured therefrom.

EXAMPLE 6

A weft backed weave was made so that the face weave had an 8-harness satin weave and the back weave a regular plain weave. Used as warp was a 50 denier/24 filament improved false twisted yarn (Trade Mark "Bleria" by Toray Industries Inc.) of polyethylene terephthalate (Trade Mark "Tetoron"), as first weft, a 200 denier/84 filament yarn of islands-in-sea type composite filaments, wherein the island component consisted mainly of polyethylene terephthalate, the sea component consisted mainly of polystylene, the percentage of the island component was 65%, the percentage of the sea component was 35% and the number of islands was 16, and as second weft, a 50 denier/24 filament false twisted polyethylene terephthalate yarn (Trade Mark "Woollie Tetoron"). The woven density was 134 warps/in, 83 first wefts/in and 83 second wefts/in.

This woven fabric was immersed in boiling water, desized, relaxed and scoured, and then, heat set and dried at 180° C. The contraction of the treated fabric was 2.5% longitudinally and 18.1% latitudinally. Then, the fabric was further processed as described in Example 1.

A suede-like weft backed raised woven fabric being excellent in draping quality and in permanent pleating quality, and having a lustrous surface whereon finger marks were easily produced was obtained. The surface of this fabric had longer naps and was softer, as compared with the surface of the fabric produced in Example 1.

EXAMPLE 7

Using a 150 denier/48 filament false twisted polyethylene terephthalate yarn (Trade Mark "Woollie Tetoron") as warp and as second weft, and a 400 denier/168 filament yarn of islands-in-sea type composite filaments, wherein the island component consisted mainly of polyethylene terephthalate, the sea component consisted mainly of polystyrene, the percentage of the island component was 70%, the percentage of the sea component was 30% and the number of islands was 16, as first weft, a 5-harness satin weft backed weave was made. The woven density was 99 warps/in, 50 first wefts/in and 50 second wefts/in. The selvage of this fabric had a 3-harness twill.

This woven fabric was processed as described in Example 1 and a high class suede-like weft backed raised woven fabric was obtained. The obtained fabric had balanced warp and weft, was voluminous and excellent in permanent pleating quality and in pilling resistance, and had a thickness of 0.87 mm. The fabric had a soft feeling surface whereon finger marks were easily produced. The density of the raised fibers was large.

EXAMPLE 8

A 5-harness satin weft backed weave was made using as warp and as second weft a 50 denier/24 filament yarn of polyethylene terephthalate (Trade Mark "Tetoron"), and as first weft a 232 denier/84 filament yarn of islands-in-sea type composite filaments, wherein the island component consisted mainly of polyethylene terephthalate, the sea component consisted mainly of polystyrene, the percentage of the island component was 80%, the percentage of the sea component was 20% and the number of islands was 36. The used islands-in-sea type composite filament yarn had a cross-section as shown in FIG. 2, wherein the majority of the islands had cross-sections of square, pentagon and hexagon as shown in FIG. 3. The woven density of the fabric was 134 warps/in, 82 first wefts/in and 82 second wefts/in.

This woven fabric was immersed in boiling water, desized, relaxed and scoured, and then, heat set and dried at 180° C. The contraction of the treated fabric was 9.0% longitudinally and 16.0% latitudinally. The treated fabric became hard like cardboard.

The fabric was thoroughly washed 4 times with trichloroethylene, to remove the sea component of the islands-in-sea type composite filaments of the first weft, and then, dried. Then, after applying a raising oil agent, the fabric was subjected to raising by passing it through a card clothing raising machine 14 times. Thus, a raised fabric was obtained, the surface of which was covered by raised fibers consisting of extra fine fibers of the first weft.

The fabric was then dyed a light brown shade with a disperse dye in a circular pressing dyeing machine, treated with a finishing oiling agent and dried.

The obtained fabric was a suede-like weft backed raised woven fabric having balanced warp and weft but no thread slippage, and being excellent in draping quality and in permanent pleating quality. The fabric had a soft feeling surface whereon finger marks were easily produced. The surface naps of the fabric were lustrous and beautiful and the density of the raised fibers was large. The reverse side of the fabric was slippery.

EXAMPLE 9

The procedure as described in Example 1 was repeated. However, in this example, the fabric was dyed in tubular forms of two types. One was in a tubular form such that one selvage was piled up the other selvage and they were sewn together so as to set the raised side of the fabric outside, and; the other was in a tubular form such that the respective pairs of the piled up selvages of two pieces of the fabric were sewn so as to set the raised sides of the two pieces of the fabric outside.

Each of the bags was dyed at 125° C. for 45 minutes, using a disperse dye in a circular pressing dyeing machine, and then, the bath was slowly cooled to 80° C. Then, the fabric was washed with hot water, subjected to reduction washing and rinsed. The thread was removed from the sewn selvages and the raised side of the fabric was subjected to wet combing by brushing said side in a prescribed direction. Then, the fabric was treated with a finishing oiling agent and dried at 130° C.

Each fabric obtained had a lustrous surface having longer raised fibers, as compared with the fabric obtained in Example 1. The reverse side of the fabric had very little fuzz in a pill form.

EXAMPLE 10

The procedure as described in Example 1 was repeated, except that as warp, first weft and second weft, respective yarns, wherein polyethylene terephthalate containing 8.5 mole % of copolymerized sodiumsulfoisophthalic acid was employed instead of the polyethylene terephthalate of the used yarns, were used and dyeing was carried out using a basic dye instead of the disperse dye.

A suede-like woven fabric of a brilliant shade was obtained.

EXAMPLE 11

A 5-harness satin weft backed weave having a woven density of 119 warps/in, 53 first wefts/in and 53 second wefts/in was made using as the warp and the second weft a 70 denier/13 filament yarn of a polymer consisting mainly of poly-ε-caprolactam, and as the first weft a 200 denier/87 filament yarn of islands-in-sea type composite filaments, wherein the island component consisted of a polymer based on poly-ε-caprolactam, the sea component consisted of a polymer based on a copolymer of 22% by weight of 2-ethylhexyl acrylate and 78% by weight of stylene, the percentage of the island component was 75%, the percentage of the sea component was 25% and the number of islands was 16.

The fabric was processed as described in Example 5 and, finally, dyed with an acid metal complex dye under atmospheric pressure.

A suede-like raised woven fabric was obtained, which had a brilliant shade, luster and a soft feel, and was excellent in draping quality and in permanent pleating quality. The fabric had no thread slippage.

EXAMPLE 12

A 5-harness satin weft backed weave as described in Example 1 was immersed in boiling water, desized, relaxed and scoured. Then, the fabric was dried, without heat setting, at a temperature between 110° C. and 120° C. The dried fabric was contracted by 8.5% longitudinally and by 12.5% latitudinally. The fabric was thoroughly washed with trichloroethylene 3 times, to remove the sea component from the islands-in-sea type composite filaments of the first weft, and dried.

The fabric was then treated with a raising oil agent and passed through a card clothing raising machine 12 times. Thus, a raised fabric was obtained, the surface of which was covered by very dense raised fibers consisting of extra fine fibers of the first weft.

Then, the fabric was dyed a light brown shade with a disperse dye in a pressing dyeing machine and treated with a finishing oiling agent. In a wet state, the raised fibers were brushed by a brush roll in a prescribed direction, and then, the fabric was heat set and dried at a temperature between 160° C. and 180° C.

The obtained fabric was a suede-like weft backed raised woven fabric having balanced warp and weft, was excellent in draping quality and in permanent pleating quality, and had a soft feeling surface whereon finger marks were easily produced.

EXAMPLE 13

A 5-harness satin weft backed weave as described in Example 1 was firstly washed with trichloroethylene 4 times, to removed the sea component from the islands-in-sea type composite filaments of the first weft, and then dried. After applying a raising oil agent, the fabric was passed through a card clothing raising machine 15 times and, thus, a raised fabric having very dense raised fibers consisting of extra fine fibers of the first weft covering its surface was obtained.

The fabric was then heat set and dried at a temperature between 160° C. and 180° C., dyed a light brown shade with a disperse dye in a pressing dyeing machine, treated with a finishing oil agent and dried at a temperature between 110° C. and 120° C. Then, the fabric was subjected to finishing brushing by a brush roll.

A suede-like weft backed raised woven fabric was obtained. The obtained fabric had balanced warp and weft, was excellent in draping quality and in permanent pleating quality, and had a soft feeling surface whereon finger marks were easily produced.

EXAMPLE 14

A 5-harness satin weft backed weave as described in Example 3 was firstly heat set at a temperature between 160° C. and 180° C. The set fabric contracted by 8.0% longitudinally and by 11.5% latitudinally. Then, after applying a raising oil agent, the fabric was passed through a card clothing raising machine 12 times to obtain a raised fabric having raised extra fine fibers covering its surface. The fabric was dyed and further processed as described in Example 9.

A suede-like weft backed raised woven fabric having balanced warp and weft, being excellent in permanent pleating quality and having a soft feeling surface whereon finger marks were easily produced was obtained. In this fabric, the density and length of the raised fibers were large.

EXAMPLE 15

A 5-harness satin weft backed weave as described in Example 1 was immersed in boiling water, desized, relaxed and scoured, and then, heat set and dried at a temperature between 160° C. and 180° C. The contraction of the treated fabric was 11.1% longitudinally and 18.9% latitudinally. The treated fabric became hard like cardboard.

The fabric was thoroughly well washed with trichloroethylene 3 times, to remove the sea component of the first weft islands-in-sea type composite filament yarn, and then dried.

The fabric was then dyed a beige shade with a disperse dye in a pressing dyeing machine and, after applying a raising oil agent, dried in a cylinder dryer. Then, the fabric was subjected to raising by passing it through a wire card clothing raising machine 13 times to obtain a raised fabric having raised extra fine fibers covering its surface. Thereafter, the fabric was treated, at 80° C. for 20 minutes, in a circulating fluid having a crumpling action and containing a finishing oiling agent, and then, the raised fibers in a wet state were brushed by a brush roll in a prescribed direction. The fabric was then dried at 120° C.

A suede-like weft backed raised woven fabric similar to that obtained in Example 1 was obtained.

What is claimed is:

1. A suede-like raised woven fabric of a combination weave having raised fibers covering the surface of said fabric, which fabric comprises a 30 to 300 denier yarn consisting mainly of continuous filaments, the mono-filament denier of which is 1.0 to 8.0 denier, used as warp, a 50 to 1,000 denier yarn of a bundle comprising continuous extra fine filaments, the mono-filament denier of which is 0.0001 to 0.4 denier, used as a first weft and a 30 to 300 denier yarn consisting mainly of continuous filaments, the mono-filament denier of which is 1.0 to 8.0 denier, used as a second weft, each thread of said first weft floating toward the adjoining 3 to 7 threads of said warp and said raised fibers consisting of said extra fine filaments which constitute said first weft of said fabric.

2. A fabric according to claim 1, wherein the number of the second weft floats is less than the number of the first weft floats.

3. A fabric according to claim 1, wherein said second weft yarn has crimps.

4. A fabric according to claim 1, wherein said warp yarn substantially has no crimp.

5. A fabric according to claim 1, wherein said warp yarn is a yarn of continuous mutifilaments, the total denier of which is in a range between 40d and 100d and the mono-filament denier of which is in a range between 1.2d and 4.5d.

6. A fabric according to claim 1, wherein the total denier of said first weft yarn is in a range between 70d and 450d.

7. A fabric according to claim 1, wherein said second weft yarn is a yarn of continuous multifilaments, the mono-filament denier of which is in a range between 1.5d and 4.0d.

8. A fabric according to claim 1, wherein said second weft yarn consists of conjugated filaments.

9. A fabric according to claim 1, wherein each thread of said first weft floats toward the adjoining 3 or 4 threads of said warp.

10. A fabric according to claim 1, wherein said fabric is resin finished.

11. A fabric according to claim 1, wherein said fabric has a weft backed weave.

12. A process for the preparation of a suede-like raised woven fabric, which comprises the steps consisting of:

(a) weaving a fabric of combination weave, wherein each thread of a first weft floats toward the adjoining 3 to 7 threads of warp, using as the warp a 30 to 300 denier yarn consisting mainly of continuous filaments, the mono-filament denier of which is 1.0 to 8.0 denier, as the first weft of yarn of multi-core composite filaments producing a 50 to 1,000 denier yarn of a bundle comprising continuous extra fine filaments, the mono-filament denier of which is 0.0001 to 0.4 denier, and as a second weft a 30 to 300 denier yarn consisting mainly of continuous filaments, the mono-filament denier of which is 1.0 to 8.0 denier;

(b) removing a component surrounding the cores of said multi-core composite filaments of the yarn constituting said first weft of the woven fabric;

(c) subjecting the woven fabric to heat treatment and;

(d) subjecting the woven fabric to raising.

13. A process according to claim 12, wherein the woven fabric is firstly subjected to heat treatment, then treated to remove the core-surrounding component and, thereafter, subjected to raising.

14. A process according to claim 12, wherein the woven fabric is firstly treated to remove the core-surrounding component, then subjected to raising and, thereafter, subjected to heat treatment.

15. A process according to claim 12, wherein the woven fabric is firstly treated to remove the core-surrounding component, then subjected to heat treatment and, thereafter, subjected to raising.

16. A process according to claim 12, wherein the woven fabric is firstly subjected to raising, then treated to remove the core-surrounding component and, thereafter, subjected to heat treatment.

17. A process according to claim 12, wherein the heat treatment is carried out at a temperature between 140° C. and 230° C.

18. A process according to claim 12, wherein the fabric is further subjected to resin finishing.

19. A process according to claim 12, wherein the fabric is further treated with a sizing agent, then subjected to resin finishing and, thereafter, treated to remove the sizing agent.

20. A process according to claim 12, wherein the fabric is further subjected to dyeing or hot water treatment in a tubular form such that the fabric is sewn up so as to set the raised side thereof outside.

21. A process for the preparation of a suede-like raised woven fabric, wherein comprises the steps consisting of:

(a) weaving a fabric of a combination weave, wherein each thread of a first weft floats toward the adjoining 3 to 7 threads of warp, using as the warp a 30 to 300 denier yarn consisting mainly of continuous filaments, the mono-filaments denier of which is 1.0 to 8.0 denier, as the first weft a 50 to 1,000 denier yarn of a bundle comprising continuous extra fine filaments, the mono-filament denier of which is 0.0001 to 0.4 denier, and as a second weft a 30 to 300 denier yarn consisting mainly of continuous filaments, the mono-filament denier of which is 1.0 to 8.0 denier;

(b) subjecting the woven fabric to heat treatment, and;

(c) subjecting the woven fabric to raising.

22. A process according to claim 21, wherein the woven fabric is firstly subjected to heat treatment and then subjected to raising.

23. A process according to claim 21, wherein the woven fabric is firstly subjected to raising and then subjected to heat treatment.

24. A process according to claim 21, wherein the heat treatment is carried out at a temperature between 140° C. and 230° C.

25. A process according to claim 21, wherein the fabric is further subjected to resin finishing.

26. A process according to claim 21, wherein the fabric is further treated with a sizing agent, then subjected to resin finishing and, thereafter, treated to remove the sizing agent.

27. A process according to claim 21, wherein the fabric is further subjected to dyeing or hot water treatment in a tubular form such that the fabric is sewn up so as to set the raised side thereof outside.

* * * * *